United States Patent [19]

Snoe et al.

[11] Patent Number: 4,561,350

[45] Date of Patent: Dec. 31, 1985

[54] SOFT DRINK CAN CRUSHER

[76] Inventors: Felix C. Snoe, c/o George Spector, 3615 Woolworth Bldg., 233 Broadway; George Spector, 3615 Woolworth Bldg., 233 Broadway, both of, New York, N.Y. 10007

[21] Appl. No.: 534,697

[22] Filed: Sep. 22, 1983

[51] Int. Cl.[4] ..... B30B 9/32

[52] U.S. Cl. ..... 100/98 R; 100/283; 100/295; 100/902

[58] Field of Search ..... 100/902, 295, 282, 283, 100/245, 98 R, 94, 95

[56] References Cited

U.S. PATENT DOCUMENTS

| | | | |
|---|---|---|---|
| 2,691,340 | 10/1954 | Nikkel | 100/282 X |
| 2,958,273 | 11/1960 | Morrow | 100/98 R |
| 3,037,446 | 6/1962 | Thompson | 100/98 R |
| 3,180,250 | 4/1965 | Johnson | 100/98 R X |
| 3,673,952 | 7/1972 | Durbin | 100/98 R |
| 3,817,169 | 6/1974 | Bischoff | 100/902 X |
| 3,893,386 | 7/1975 | Wise | 100/282 X |

FOREIGN PATENT DOCUMENTS

| | | | |
|---|---|---|---|
| 845438 | 11/1952 | Fed. Rep. of Germany | 100/98 R |

*Primary Examiner*—Billy J. Wilhite

[57] ABSTRACT

A soft drink can crusher, including a piston slidable in a cylinder, and a motor drive for a connecting rod pushing the piston against a metal can placed in one end of the cylinder and crushing the can against an anvil.

2 Claims, 5 Drawing Figures

Fig. 1
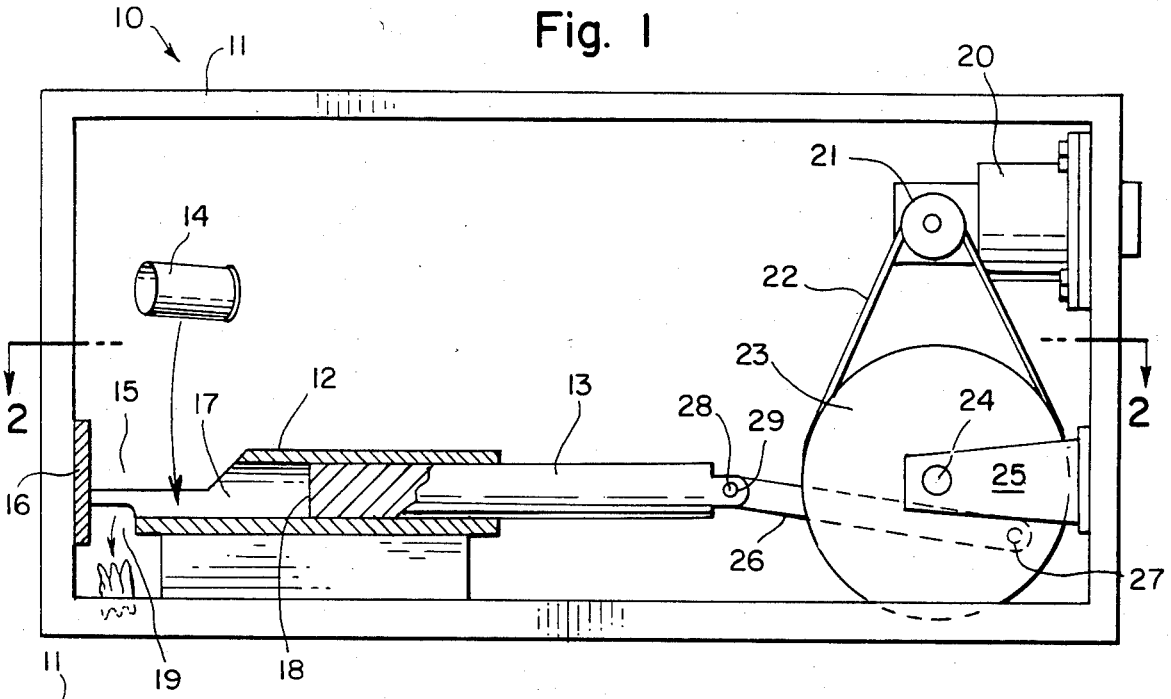
Fig. 2
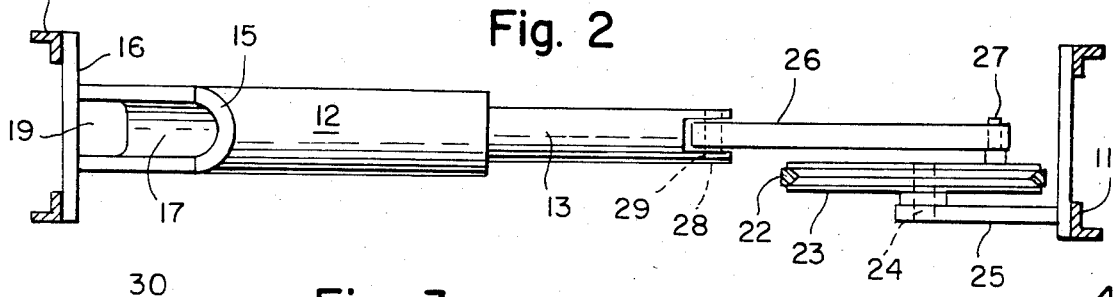
Fig. 3
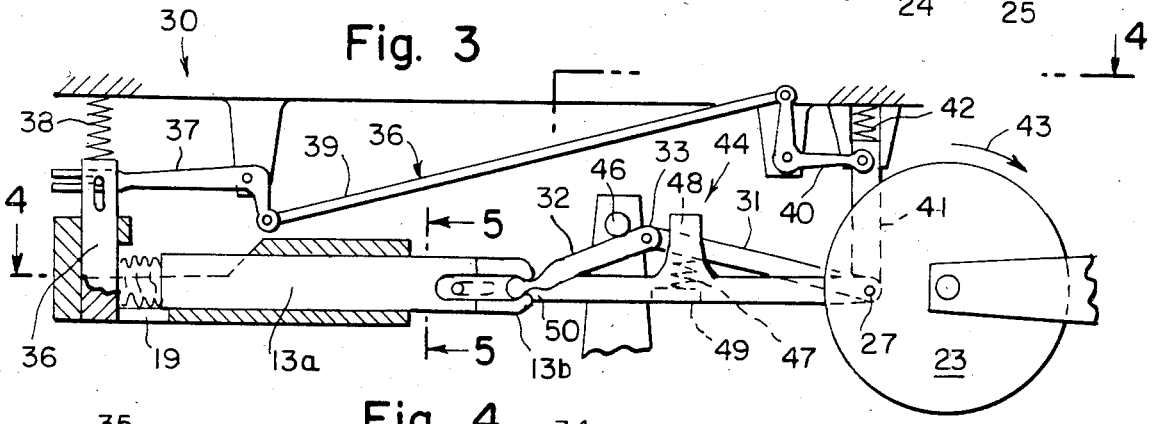
Fig. 4
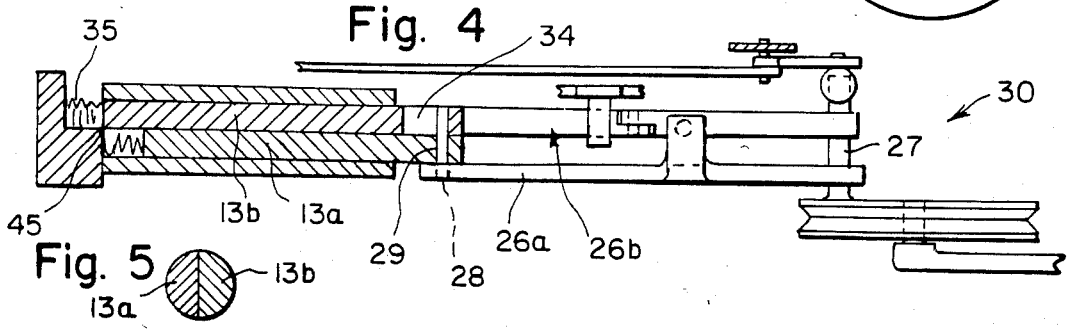
Fig. 5

SOFT DRINK CAN CRUSHER

This invention relates generally to crushing machines.

It is well known that in a modern society, refuse is being generated in larger amounts than in earlier times when man lived more self-sufficiently. Today many of the foods we eat, come in tinned cans which after being emptied, must be discarded, so that in a relatively short time, an average household accumulates a larger volume of such refuse, which is usually put into bags for being carted away by refuse collectors. These empty cans, as presently being placed in a bag, take up a lot of space, so that the bag is soon filled up. Accordingly, there seems to be a need for some means whereby more cans can be fitted in a bag for purpose of greater efficiency in handling.

Therefore it is a principal object of the present invention, to provide a machine that crushes emptied cans so that they take up less space, thus allowing more of them to fit inside a bag.

Another object is to provide a can crusher which may be made particularly for the aluminum cans such as are now used for soft drinks, and which constitutes a vast market, in view of the larger consumption of soft drinks by teenagers and a great many others, so that such machine would be ideal for use, not only at home, but also at fast food stands and restaurants that sell large quantities of soft drinks in cans.

FIG. 1 is a side elevation view of the invention.

FIG. 2 is a cross sectional view taken on line 2—2 of FIG. 1.

FIG. 3 is a side elevation view of another design of the invention in which the crushed cans are additionally cut in half in order to be still smaller and that be able to be more compactly disposed in limited space.

FIG. 4 is a cross sectional view on line 4—4 of FIG. 3, and which illustrates a cycle component which follows the cycle component illustrated in FIG. 3.

FIG. 5 is a transverse cross sectional view taken on line 5—5 of FIG. 3.

Referring now to the drawing in greater detail, and more particularly to FIGS. 1 and 2 thereof, at this time, the reference numeral 10 represents a Soft Drink Can Crusher according to the present invention, wherein there is a frame 11 upon which there is stationarily mounted a horizontal sleeve cylinder 12 inside which a plunger piston 13 is slidable for crushing a soft drink metal can 14 dropped into a top opening 15 formed adjacent one end of the cylinder that abutts a flat anvil plate 16 stationarily mounted on the frame. Thus the can in the cylinder chamber 17, is crushed between the end 18 of the piston and the anvil plate, the crushed can then dropping outwardly of the cylinder through an opening 19 on a bottom of the cylinder.

The piston is reciprocally slided back and forth by means of an electric motor 20 fixedly mounted on the frame, the motor driving a pulley 21 that is connected by an endless belt 22 to a pulley 23 rotated on a shaft 24 journalled in a bearing of a bearing block 25 also fixedly mounted on the frame. A connecting rod 26 is connected at one end on a pin 27 eccentrically mounted on a side of the pulley 23, and the other end of the connecting rod is connected to a cross pin 28 extending through a cross hole 29 of the plunger.

Thus, in operative use, as the motor operates, the piston reciprocally slides so to crush cans, one at a time, inside the chamber 17.

In a modified design of Soft Drink Can Crusher 30, shown in FIGS. 3,4 and 5, a generally similar construction is used as in the above described design 10, except that additional structure is included in order to cut the crushed can into half, so as to further take up less space, than if left whole.

The design 30 accordingly includes the plunger 13 being divided into two members 13*a* and 13*b*, and the connecting rod 26 being likewise divided into members 26*a* and 26*b* for pushing the respective plunger members. The connecting rod member 26*b* is additionally comprised of a pair of links 31 and 32 pivotally mounted at one end on a cross pin 33.

In this design, however, while the cross pin 28 fits in the cross hole 29 of the plunger member 13*a*, the cross pin 28 fits in a front end of a cross slot 34 of the plunger member 13*b* instead, so that the cross pin 28 serves to push both plunger members against the can during the can crushing action.

In order to cut the can, after the crushing action, the anvil 16 includes a notch 35 that faces the end of the plunger member 13*b*. During the can crushing action, the notch is filled by a slide 36 so as, together with the anvil, it presents a flat face against which the can rests while the plunger members push against it.

After the can is crushed, the slide is automatically pulled out of the notch by means of a mechanism 36, so that the notch permits the portion of the can in front of plunger, member 13*b* to enter thereinto.

The mechanism 36 includes a rocker arm 37 that lifts the slide against the action of a spring 38, the rocker arm being pushed by a rod 39 which in turn, is pushed by a rocker arm 40 activated by a push bar 41. One end of the push bar is positioned in the path of the pin 27 so as to be lifted out of the way thereof and against the action of a spring 42. As is evident in FIG. 3, the pulley needs to rotate a minimal few degrees to push the bar 41 out of the way of the pin 27, during when the slide is thus relatively quickly lifted from the notch. As the pulley than continues to rotate in the direction indicated by the arrow 43, the plunger members 13*b* is then slowly pushed forwardly by a mechanism 44 so to push a half of the crushed can into the notch, thus cutting the can in half on the corner edge 45. During a return movement of the plunger members, both crushed can halves drop out of the machine.

The mechanism 44 includes a stationary stop 46 on the machine frame, and which is struck by the connecting rod member 26*b* during each rotation of the pulley 23. The connecting rod member 26*b* normally is held in a bent condition as shown in FIG. 4.

By means of a spring 47, the connecting arm members 26*b* extending through a spaced formed between sideward arms 48 and 49 made on the connecting arm member 26*a*. The stop is struck by the connecting rod member 26*b* each time that the pin 27 moves from the nine o'clock position on the pulley, as shown in FIG. 3, to the twelve o'clock position, the stop causing the member 26*b* to straighten out and thus push the piston member 13*b* further against the can and cut it in half on the corner edge 45, as described above. In the remaining cycle of the pulley rotation, the slide is back in the notch 35 and the member 26*b* is in its bent position again.

In summary, it is to be noted that during the can crushing operation, the cross pin 28 pushes both piston members against the can, while during the can cutting operation, this cross pin is dispaced toward the rear of the cross slot 34 as the connecting rod member 26*b* is straightened out. Also it is to be noted that this member 26*b* pivots on a rear end of piston member 13*b*, as shown at 50.

While various changes may be made in the detail construction, it is understood that such changes will be within the spirit and scope of the present invention as is defined by the appended claims.

What is claimed:

1. A soft drink can crusher, comprising in combination, a frame, a cylinder affixed on the frame, a piston slideable inside the cylinder, means for reciprocating said piston in said cylinder, an anvil at the end of said cylinder, said piston being forced by said means against a can placed in an end of said cylinder adjacent said anvil in further combination with means to cut said can in half, after the can has been crushed responsive to further piston reciprocation, wherein said piston is made of two piston members, each of which is aligned to bear against said can, and means whereby one said members is moveable to a position further advanced against said can than the other, wherein the anvil includes a portion moveable to a position out of alignment with said piston when it is moveable to said position further advanced, including means for moving said anvil portion responsive to piston reciprocation.

2. The combination of claim 1, wherein one of said piston members includes a linkage connected to the moveable anvil portion whereby reciprocation of the piston causes said linkage to move said anvil portion out of alignment when the piston is moved to the advanced position.

* * * * *